US005138863A

United States Patent [19]

Kistner et al.

[11] Patent Number: 5,138,863

[45] Date of Patent: * Aug. 18, 1992

[54] COUPLING FOR A GAS PIPE JOINT AND ASSOCIATED METHOD FOR MAKING SAME AND DEVICE THEREFOR

[75] Inventors: Anthony S. Kistner, Greensburg; Wayne M. Staats, Pittsburgh; Norman O. Staats, Irwin, all of Pa.

[73] Assignee: O.M.S., Inc., Irwin, Pa.

[ * ] Notice: The portion of the term of this patent subsequent to Jan. 29, 2008 has been disclaimed.

[21] Appl. No.: 733,200

[22] Filed: Jul. 19, 1991

Related U.S. Application Data

[62] Division of Ser. No. 489,477, Mar. 5, 1990, Pat. No. 5,033,301.

[51] Int. Cl.[5] ..... B21D 39/20

[52] U.S. Cl. ..... 72/353.4

[58] Field of Search ..... 72/125, 353 A, 393; 29/507

[56] References Cited

U.S. PATENT DOCUMENTS

| | | | |
|---|---|---|---|
| 284,107 | 8/1883 | Wheelock . | |
| 417,323 | 12/1889 | John . | |
| 1,057,664 | 4/1913 | Patterson | 72/393 |
| 1,381,033 | 6/1921 | Thornton . | |
| 1,610,796 | 12/1926 | King | 72/393 |
| 1,706,910 | 3/1929 | Wright et al. . | |
| 1,842,573 | 1/1932 | Van Treek . | |
| 1,938,194 | 12/1933 | Rader | 153/82 |
| 2,481,628 | 9/1949 | Sherman | 153/1 |
| 2,497,633 | 2/1950 | Shapiro et al. | 81/72 |
| 2,672,175 | 3/1954 | Howard | 153/80 |
| 2,991,674 | 7/1961 | Uhl | 81/15 |
| 2,999,529 | 9/1961 | Rast | 153/80 |
| 3,324,701 | 6/1967 | Shultz | 72/393 |
| 3,338,082 | 8/1967 | Steele et al. | 72/393 |
| 4,034,591 | 7/1977 | Rothenberger | 72/393 |
| 4,138,873 | 2/1979 | Dailey | 72/316 |
| 4,262,518 | 4/1981 | Creger et al. | 72/393 |
| 4,583,389 | 4/1986 | Thomas | 72/402 |
| 4,733,551 | 3/1988 | Bryant et al. | 72/393 |
| 4,735,078 | 4/1988 | Wesebaum | 72/393 |
| 4,753,101 | 6/1988 | Shultz | 72/393 |
| 4,987,763 | 1/1991 | Kistner et al. | 72/353.4 |

FOREIGN PATENT DOCUMENTS 2067707 7/1981 United Kingdom .

*Primary Examiner*—Lowell A. Larson

*Attorney, Agent, or Firm*—Nils H. Ljungman & Associates

[57] ABSTRACT

An apparatus and associated method is for forming an end of a piece of gas conduit and attaching it to a second piece of conduit. The apparatus is provided for smoothing the end of a corrugated conduit and expanding it to a predetermined diameter. An associated connector is then applied to the smoothed end of the corrugated conduit and the conduit and the connector are then connected to the second piece of conduit. An associated method provides steps for achieving such a connection.

21 Claims, 17 Drawing Sheets

FIG. 4
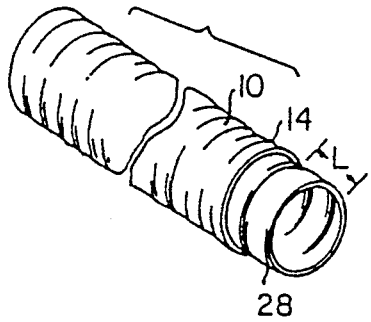
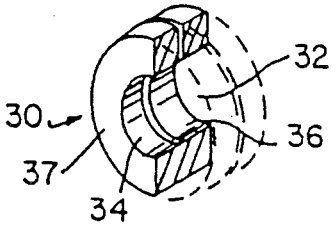
FIG. 5
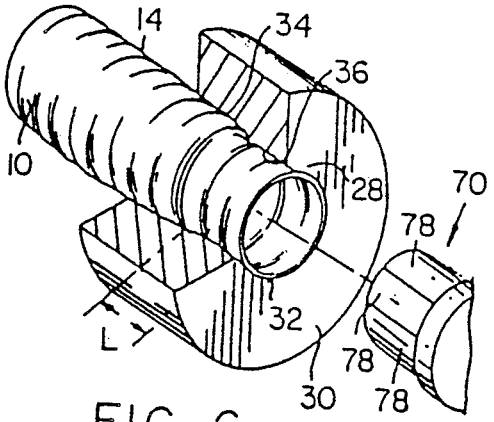
FIG. 6

FIG. 7
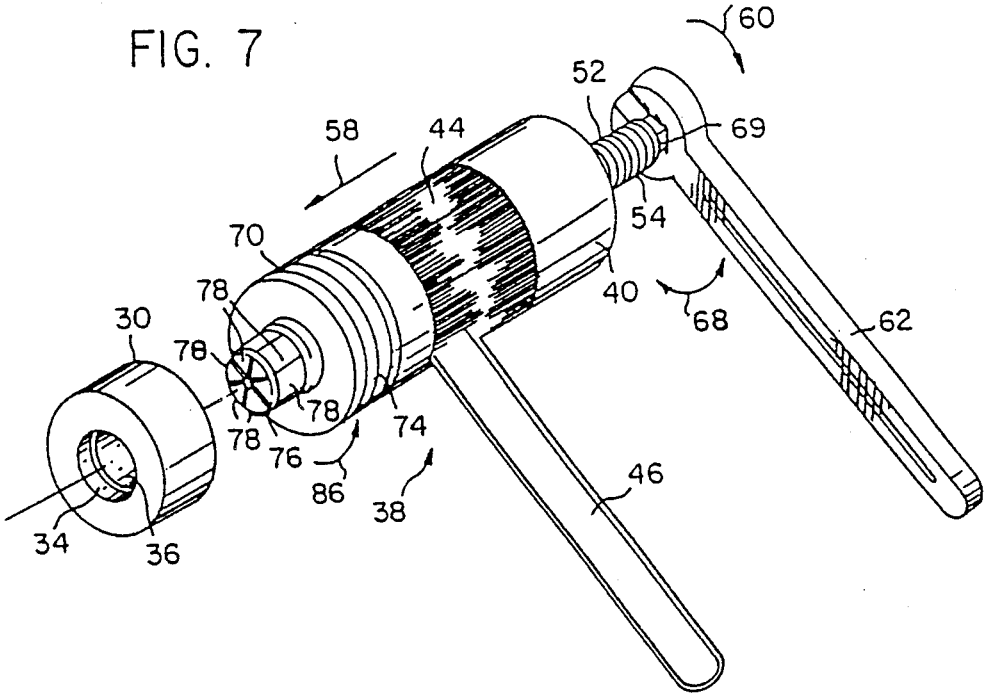
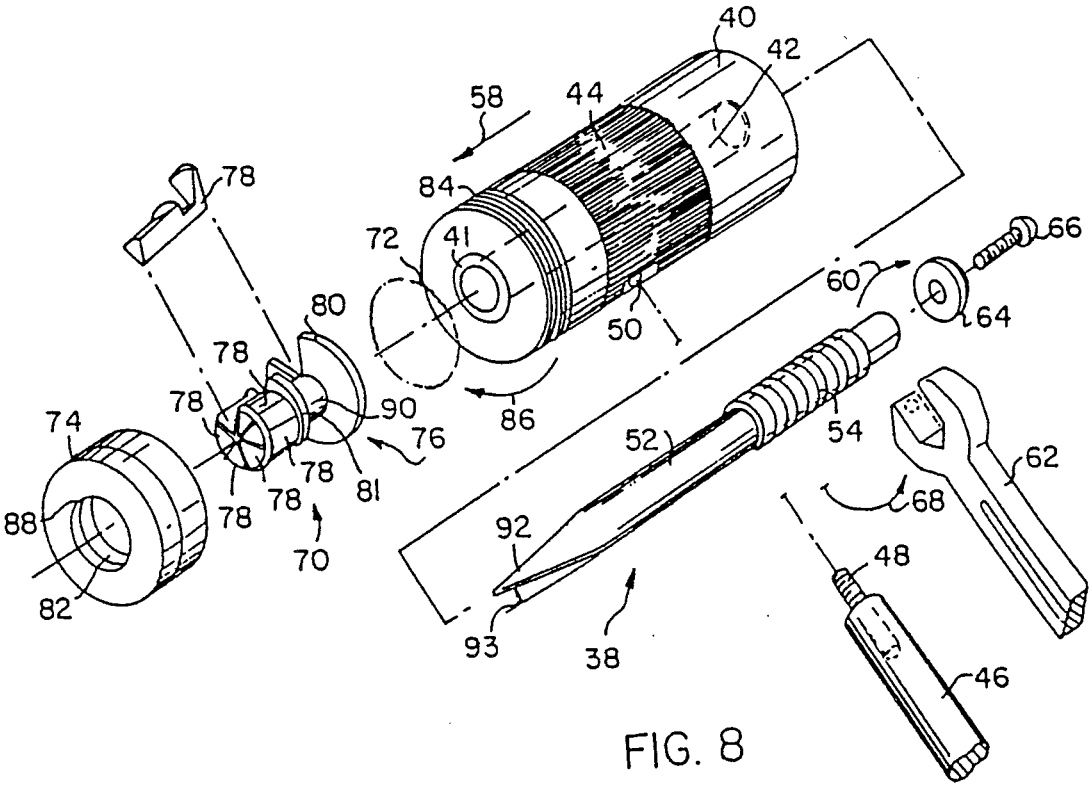
FIG. 8

WASHER

CORE PIN

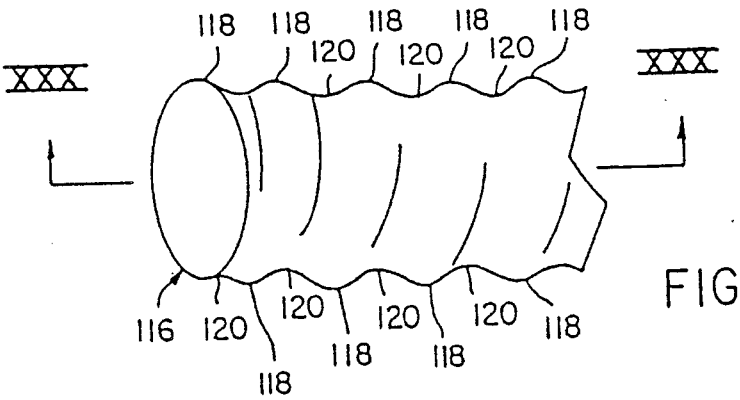
FIG. 29
FIG. 30
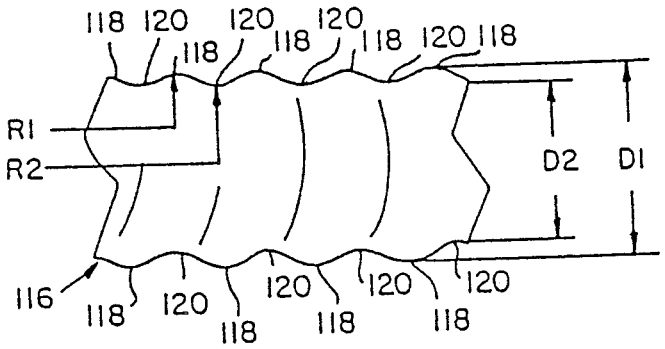
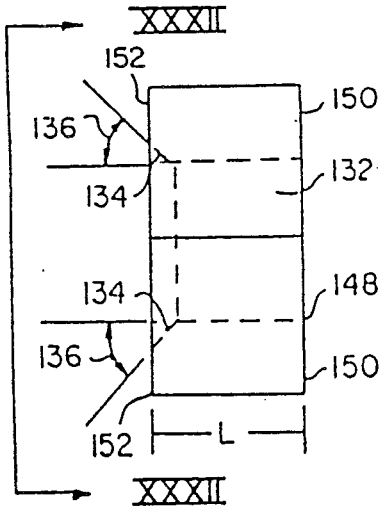
FIG. 31

COUPLING FOR A GAS PIPE JOINT AND ASSOCIATED METHOD FOR MAKING SAME AND DEVICE THEREFOR

This is a division of application Ser. No. 07/489,477, filed on Mar. 5, 1990, now U.S. Pat. No. 5,033,301.

BACKGROUND OF THE INVENTION

1. Field of the Invention

The present invention relates to apparatus and an associated method for making a gas conduit coupling structure for a pressurized gas conduit and, more specifically, for making a conduit coupling structure which does not require welded parts.

2. Background Information

Conduits are well known in the prior art. Conduits may be employed for a variety of purposes, such as for encasing and supporting electrical conductors and for the transporting or channeling of fluids. A variety of methods are employed to produce such conduits. Such methods include metal extrusion, wherein metal is extruded through an extrusion die to form the conduit, and metal casting, wherein metal is cast in a mold to form the conduit.

One particularly advantageous way of forming conduit is by forming already corrugated sheet metal, such as stainless steel which may be 304 stainless steel, into a tubular shape and welding the seam which is formed where the sides of the sheet metal meet. Another particularly advantageous way of forming conduit is to form generally flat, sheet metal, such as 304 stainless steel, into a tubular shape, weld the seam which is formed where the sides of the sheet metal meet and then corrugate the tube. Such corrugated tubing is useful in a variety of applications. Also, non-corrugated conduit, such as copper tubing, may be employed in certain applications.

Frequently, when gas conduit is run through a building, the conduit must change its direction of path a number of times. One way to allow for such directional change is through the employment of elbow-type fittings or connectors. The employment of such elbow-type devices is, sometimes, undesirable since the fittings or connectors are relatively expensive and increase the risk of leaks when the conduits are employed for the purpose of containing a fluid such as a gas or liquid, since a positive seal between the conduit and the fitting may not always be achieved. Another method of changing the direction of conduit is, simply, by bending the conduit at the desired locations of changes of direction of the path of the conduit.

Devices for properly bending non-corrugated conduit are well known. However, if the bending devices are not used properly, or if the conduit is simply bent without the employment of such bending devices, the conduit may bend at too small of a radius of curvature, thereby forming what is generally known as a "kink." A kink may narrow the inside diameter of the conduit to such an extent that fluid flow, therethrough, is restricted or possibly even stopped. A kink may be so severe that a hole may even form in the wall of the conduit, thereby allowing escape of the fluid from the conduit.

One advantage of using non-corrugated conduit is that end fittings have been developed, such as standard, well known compression type fittings, to provide a simplified means of connecting the tubing to another section of tubing or some other device such as a connector. Therefore, while the employment of non-corrugated conduit provides an advantage in the simplified connection of the conduit to another device, it has the disadvantage of being difficult to change the direction of the path of the conduit, as described above.

Corrugated conduit, on the other hand, may be easily bent for changes in direction of path, with little risk of kinking, because the corrugated configuration significantly reduces the risk of kinking. However, due to the corrugated, or rippled, surface of the conduit, standard compression fittings have not, heretofor, been effective for providing a fluid tight seal between the ends of the conduit and another piece of conduit or a connector. The ineffectiveness of the seal is due to the fact that such compression fittings rely, in part, on a conduit which has a relatively smooth, exterior end surface, such as is present in copper tubing, to provide the necessary seal. Therefore, typical corrugated conduit requires fittings which must be welded to the conduit to provide an effective seal. Such welding, however, is inconvenient and relatively expensive.

Thus, the advantages and disadvantages encountered when using corrugated conduit are opposite the advantages and disadvantages provided by copper tubing since corrugated conduit is easily bent but difficult to easily connect to other devices while the copper tubing is relatively difficult to bend but provides easy connection to other devices.

Therefore, a need exists to provide a conduit for fluids or gas which is both easy to bend and easy to connect to other devices. The present invention has fulfilled this need.

SUMMARY OF THE INVENTION

One aspect of the invention resides broadly in an apparatus for forming the structure for the end of a conduit for a gas transmission comprising: mold apparatus for being positioned in contact with the conduit; and forming device for being positioned in contact with the end of the conduit; mold apparatus and forming device being configured to cooperatively form the conduit end structure.

Another aspect of the invention resides broadly in a method of forming an end of a gas conduit comprising the steps of: providing a gas conduit and providing an apparatus for altering the contour of the end of the conduit so that the conduit end may be effectively mated with a fitting.

Still another aspect of the invention resides broadly in a method of forming an end of a conduit comprising the steps of: providing a conduit; providing mold apparatus for being positioned in contact with the conduit for defining a dimension of the conduit; providing a forming device for being positioned in contact with the conduit for conforming the conduit to a generally defined dimension; and conforming the conduit to a defined dimension with the mold apparatus and the forming device.

BRIEF DESCRIPTION OF THE DRAWINGS

The following detailed description of the preferred embodiments may be better understood, and further advantages of the present invention are more apparent, when taken in conjunction with the appended drawings in which:

FIG. 4 is a perspective view of a piece of conduit in which a portion of the exterior plastic jacket has been removed;

FIG. 5 is a perspective view, partially in section, of a forming tool of the present invention;

FIG. 6 is a perspective view, partially in section, of the conduit of FIG. 4 being inserted within the forming tool of FIG. 5 and a perspective view of a portion of the expanding tool of the present invention:

FIG. 7 is a perspective view of the expanding tool of the present invention and the forming tool shown in FIGS. 5 and 6:

FIG. 8 is an exploded view of the expanding tool of the present invention;

FIG. 29 is a perspective view of a corrugated conduit;

FIG. 30 is a sectional view of a portion of the conduit shown in FIG. 29 taken along a portion of line XXX—XXX:

FIG. 31 is a side elevational view of another embodiment of the forming tool of the present invention;

DETAILED DESCRIPTION OF THE PREFERRED EMBODIMENTS

Figure 1:
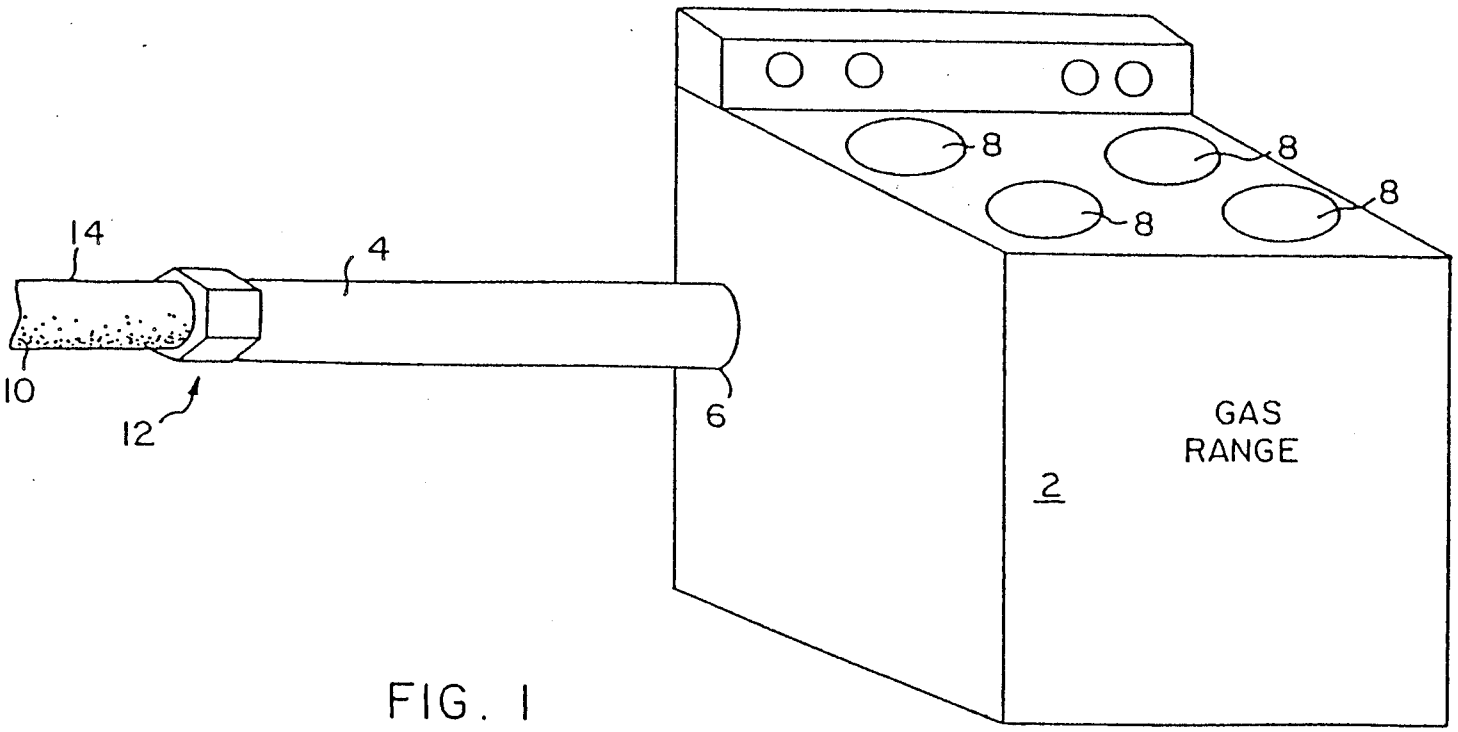
FIG. 1 is a perspective view of a gas range that is connected to a gas conduit employing the present invention.

FIG. 1 shows gas range 2, which may be a typical gas range which operates by either natural gas or liquid petroleum gas. Such ranges are well known in the prior art and form no part of the present invention. Conduit 4 enters range 2 through opening 6. Gas, for the operation of burners 8, is pumped under pressure through conduit 10, conduit joint 12 and conduit 4 and enters range 2 through opening 6. Conduit joint 12 is provided to connect conduit 4 to conduit 10.

It is desirable, under these circumstances, to provide a gas conduit which is air-tight so that a fluid, such as natural gas, may be provided under pressure within the conduit. Under such circumstances, it is necessary that the joints between conduit sections, such as conduit joint 12 between conduit 4 and conduit 10, be sealed so that none of the fluid within the conduit sections escapes through the joint.

The present invention provides such a sealed conduit joint. The apparatus and method of the present invention is depicted in FIGS. 1 through 35 of the appended drawings.

Conduit 10 is a typical and well-known corrugated conduit which may be made of stainless steel, such as 304 stainless steel and which may include a circumferential plastic, vinyl, rubber or polymer jacket 14. Conduit 10 may be formed as described above or in any other manner as is known to those of ordinary skill in the art.

Figure 3:
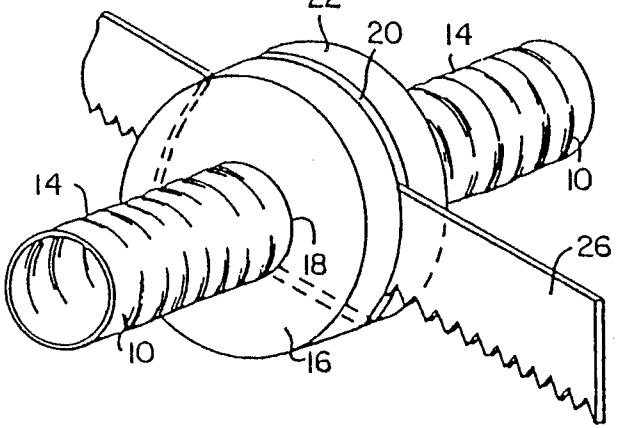
FIG. 3 is a perspective view of a piece of conduit that is being cut through the employment of the apparatus shown in FIG. 2.
Figure 2:
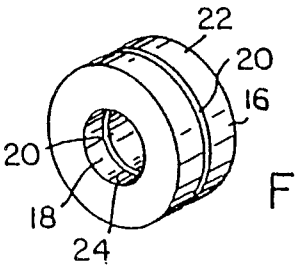
FIG. 2 is a perspective view of a conduit cutting tool that is employed in the present invention.

To properly prepare conduit 10 for connection, by conduit joint 12, with another conduit such as conduit 4 or some other device, conduit 10 is first cut to a desired length through the employment of cutting tool 16. Cutting tool 16, as shown in FIGS. 2 and 3, is a, generally, circumferentially shaped member which defines a, generally, circular opening 18. Opening 18 is, preferably, of a diameter which is slightly larger than the diameter of conduit 10, with attached jacket 14, so that conduit 10 and jacket 14 may be, relatively, easily slid through opening 18.

Cutting tool 16 also includes slot 20 which extends all the way through cutting tool 16 from the top portion of outer surface 22 to the bottom portion of inner surface 24. Conduit 10 is positioned within cutting tools 16 so that the desired cut off point of conduit 10 is positioned adjacent slot 20.

Cutting blade 26, which may be a typical and well known hacksaw blade, is then positioned within slot 20 and employed to saw entirely through conduit 10. Such cutting action, through the employment of cutting tool 16, produces a, generally, squared-off end surface on conduit 10.

As shown in FIG. 4, a portion of jacket 14, of length L, which may be 13/16 of one inch, is then cut off of conduit 10 to provide an exposed conduit end 28, which is the corrugated metal conduit without the jacket. To properly connect conduit 10 to another device, such as conduit 4, without the use of a welded fitting, it is frequently necessary to smooth out the surface of conduit end 28 by removing the corrugations since such corrugations may prevent an adequate seal from being formed with non-welded fittings.

FIG. 5 shows forming tool 30. Forming tool 30 is, generally, a circumferentially shaped member which defines opening 32. Forming tool 30 includes inner surfaces 34 and 36, which are of different diameters. As shown in FIG. 6, conduit 10 is inserted into opening 32 of forming tool 30. Inner surface 34 is sized to be of a diameter which is large enough to accommodate conduit 10 with jacket 14. However, inner surface 36 is sized to be of a diameter which admits conduit 10 but is too small of a diameter to admit jacket 14. Therefore, only conduit end 28 is positioned adjacent inner surface 36 of forming tool 30. Inner surface 36 is, preferably, of a diameter which is the desired finished, outer diameter of conduit end 28 and has a longitudinal length equal to L.

Figure 6B:
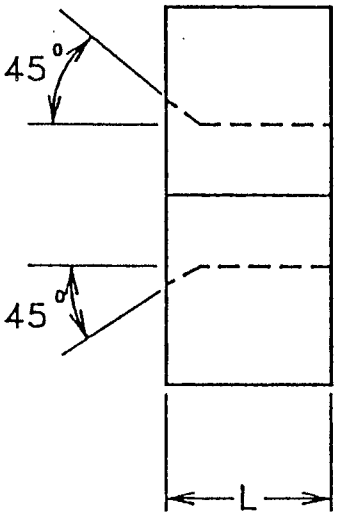
FIGS. 6*a* and 6*b* area side elevational views, partially in section, of other embodiments of the forming tool of FIG. 6.
Figure 6A:
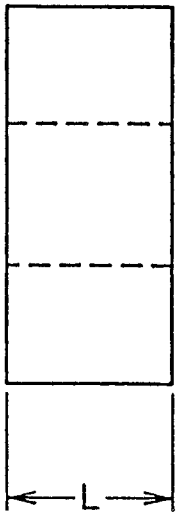

Alternatively, as shown in FIGS. 6*a* and 6*b*, the diameter of the entire inner surface of forming tool 30 may be made equal to the desired finished diameter of conduit end 28 and the entire longitudinal length of tool 30 may be equal to length L. With this embodiment, none of jacket 14 would enter opening 32 of forming tool 30. Rather, the end surface of jacket 14 would merely, abut exterior surface 37 of forming tool 30.

Expanding tool 38, as shown in FIGS. 7 through 11, at least partially removes the corrugation from conduit end 28. Expanding tool 38 comprises cylinder 40 through which at least partially threaded bore 42 is formed.

Cylinder 40 may be made from aluminum alloy 6061-T6, which bears U.S. Government Specification No. QQ A 22518, and has a hardness, or wearability, designated as temper T6.

Bushing 41 may be provided in bore 42, as shown in FIG. 8, to reduce frictional wear. Bushing 41 may be made of 4140 steel, which may be heat treated before use. One acceptable method of heat treating bushing 41 is to heat the 4140 steel to about 1,200° F. and soak it at that temperature for one hour. The steel is then heated to about 1,500° F. and soaked at that temperature for one hour. The steel is then oil quenched to reduce the temperature to about 150° F. Afterwards, the steel is tempered at about 850° F. and soaked at that temperature for one hour. This process gives it a hardness of 42/44 RC on the Rockwell C Test Scale.

As seen FIG. 8, one method of installing bushing 41 in cylinder 40 is by heating cylinder 40 to expand the diameter of bore 42, positioning bushing 41 in bore 42 and cooling cylinder 40 to reduce the diameter of bore 42 to snuggly engage bushing 41. This method is commonly referred to as "shrink fitting."

Cylinder 40 may include knurled or gripping surface 44 which aids a person in holding expanding tool 38. Also, expanding tool 38 may include handle 46. Handle 46 may be attached to cylinder 40 through bolt 48 which may be tapped into handle 46. Bolt 48 is designed to be screwed into cylinder 40 through threaded opening 50.

Figure 9:
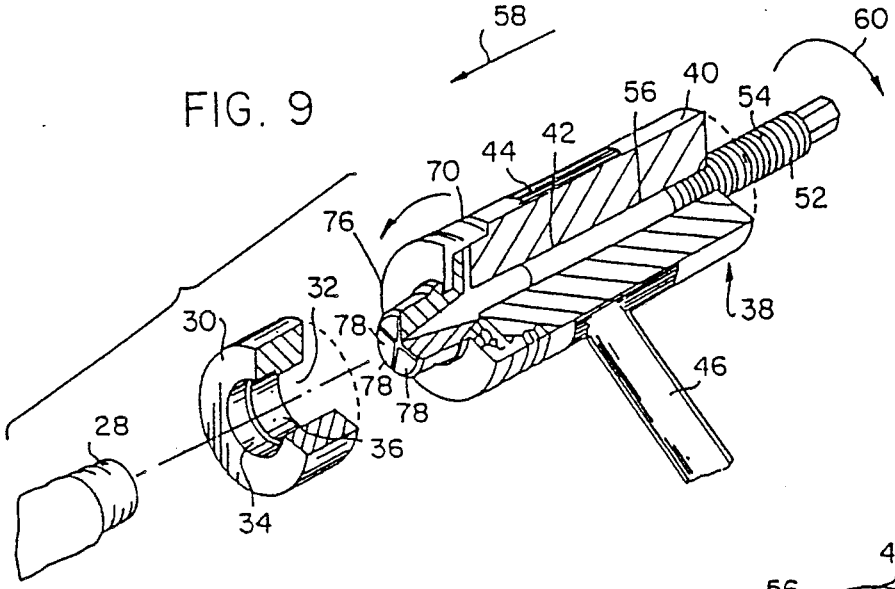
FIG. 9 is a perspective view, partially in section, of the expanding tool and forming tool of the present invention and a perspective view of the conduit of FIG. 4.

Referring to FIG. 9, wedge member 52 is at least partially threaded with threads 54 so as to cooperate with threads 56 which are formed in the exterior surface of bore 42. Wedge member 52 may be made of A-2 steel. Also, the steel may be heat treated according to the following method. The steel is first preheated to about 1,200° F. and then the temperature is adjusted to between about 750° F. and about 775° F. and held at that temperature for one hour. Afterwards, the steel is cooled in air to a temperature of about 150° F. The steel is then transferred to another furnace where it is draw tempered at about 750° F. for one hour. This process gives the steel a hardness of 56/58 RC on the Rockwell C Test Scale. Threads 54 and 56 may be left-handed threads so that wedge means 52 moves in the direction of arrow 58 when wedge means 52 is rotated in the direction of arrow 60.

Handle 62, shown in FIG. 8, is provided for rotation of wedge means 52. In the form shown, handle 62 is a quick connect/disconnect snap-type wrench. This allows for the quick connection and disconnection of handle 62 from expanding tool 38 for, for example, storage purposes. Of course, handle 62 may also be of the type which has a closed socket. Such a closed socket would necessitate removal of washer 64 and bolt 66 for the installation and removal of handle 62. Washer 64 and bolt 66 may be provided to limit or prevent any undesired relative movement between handle 62 and wedge means 52 along arc 68. Also, handle 46 may be unscrewed from expanding tool 38 when desired, for example, for storage purposes. Handle 62 may, also, employ ratchet 69 (not shown) to limit the direction of rotation of wedge member 52 when handle 62 is only partially rotated back and forth, alternately, in the direction of and opposite arrow 60.

Now referring to FIGS. 7, 8 and 9, head 70 may be a commercially marketed head or collet which is identified under the name RIGID, and which may be custom machined for size and shape. Alternately, head 70 may be constructed by machining and cutting standard bar stock to form expansion segments 78 and machining a cylindrical piece of metal to form collar 74.

Head 70, which may be a collet, comprises biasing means 72, collar 74 and expansion means 76. Expansion means 76 comprises a plurality of individual expansion segments 78 best seen in FIG. 8. Expansion segments 78 are movably held together to form expansion means 76 by biasing means 72 which may be a circumferential spring adapted to fit, in tension, in groove 80. Alternately, groove 81 may be provided for holding a spring, 0-ring or similar biasing means exterior to collar 74.

Collar 74 includes threads 82, which are adapted to cooperate with threads 84 which are formed in the surface of cylinder 40, as seen in FIG. 8. Threads 82 and 84 may be right-handed threads so that collar 74 screws onto cylinder 40 when collar 74 is rotated in the direction of arrow 86 relative to cylinder 40.

It is advantageous to have threads 82 and 84 adapted for engaging rotation in one direction and threads 54 and 56 adapted for engaging rotation in the opposite direction. This configuration is advantageous because if threads 54, 56, 84 and 86 are all adapted for engaging rotation in the same direction, collar 74 might have a tendency to unscrew when wedge means 52 is being moved in the direction of arrow 58. The employment of left-handed threads for one member and right-handed threads for the other member eliminates this undesirable situation.

Figure 10:
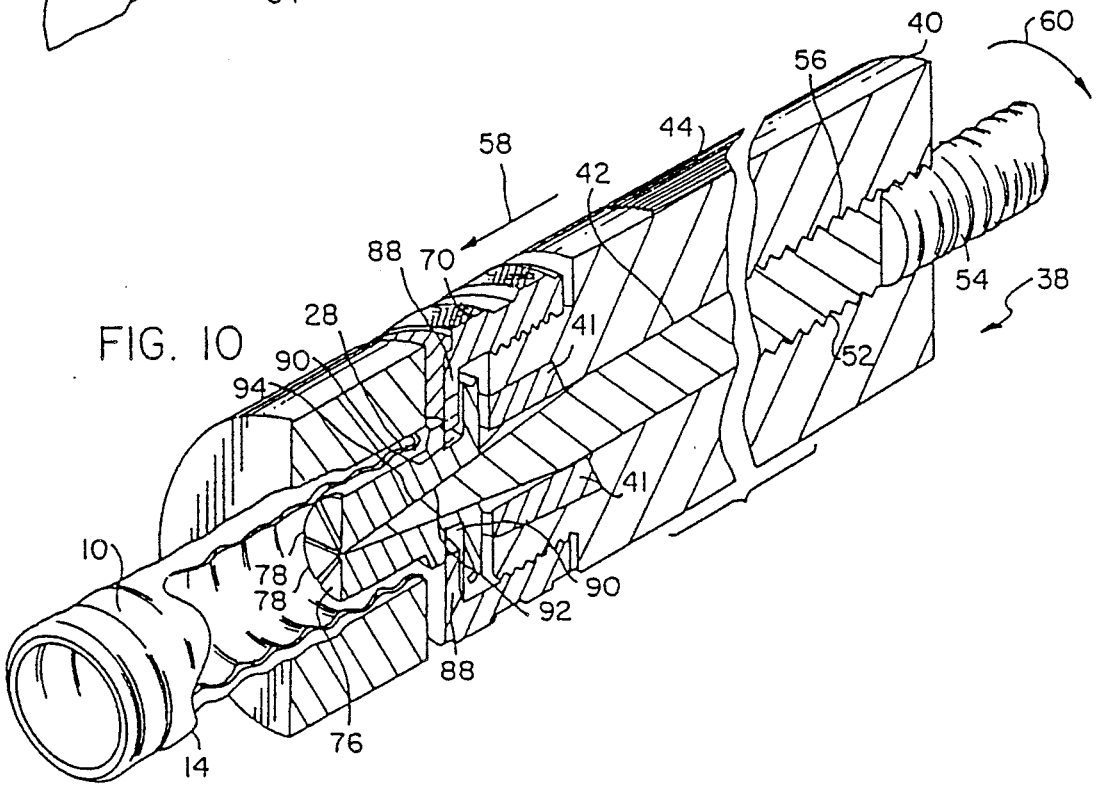
FIG. 10 is a perspective view, partially in section, of the present invention, in which a portion of the conduit of FIG. 4 has been inserted, before removal of the corrugation.
Figure 11:
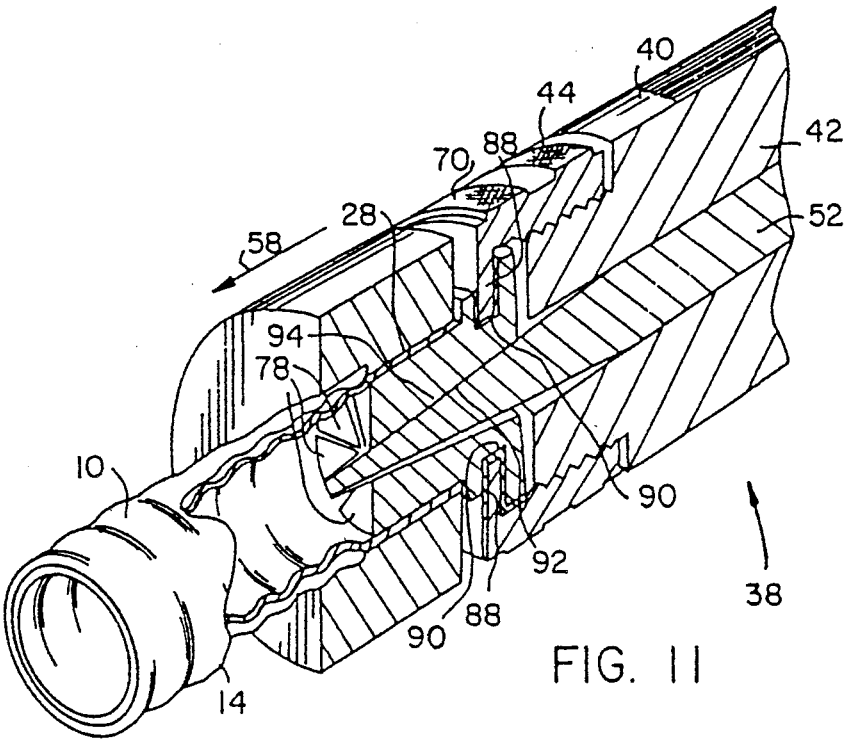
FIG. 11 is a perspective view, partially in section of the present invention in which a portion of the conduit of FIG. 4 has been inserted, after removal of the corrugation.

In FIGS. 10 and 11, generally annular shoulder 88 is adapted to be received in, generally, annular groove 90 of expansion means 76 to secure expansion means 76 in a rotatable manner to collar 74.

In use, conduit 10 is cut to a desired length and a portion of jacket 14, generally corresponding to length L, is removed from conduit 10 as described above. Alternately, a conduit may be used which does not employ jacket 14 at all. In either case, conduit end 28 is fully positioned in forming tool 30, with little or no protrusion of conduit end 28 from forming tool 30, as shown in FIG. 6. Expansion means 76, which has an outer diameter that is slightly smaller than the inner diameter of conduit 10, is then positioned within conduit end 28, as shown in FIG. 10.

At this point, little or no force is applied by expansion means 76 against conduit end 28 due to the relative outer and inner diameters, respectively, of those two members. A person then grips handles 46 and 62 and rotates handle 62, relative to cylinder 40, in the direction of arrow 60. This causes wedge means 52 to move linearly in the direction of arrow 58. Wedge surface 92 of wedge means 52 applies a force to corresponding surface 94 of expansion segments 78. That, in turn, causes expansion segment 78 to flare-out, generally, radially. Conduit end 28 is, thus, squeezed between the outer surface of expansion segments 78 and inner surface 36 of forming tool 30.

The person continues to rotate handle 62, relative to cylinder 40, until a sufficient force has been applied to sufficiently flatten the corrugations out of conduit end 28 as shown in FIG. 11. Generally, 10 to 40 pound-feet of torque applied between handles 46 and 62 is sufficient to remove the corrugations. One acceptable value of torque is about 20 pound-feet.

Figure 15:
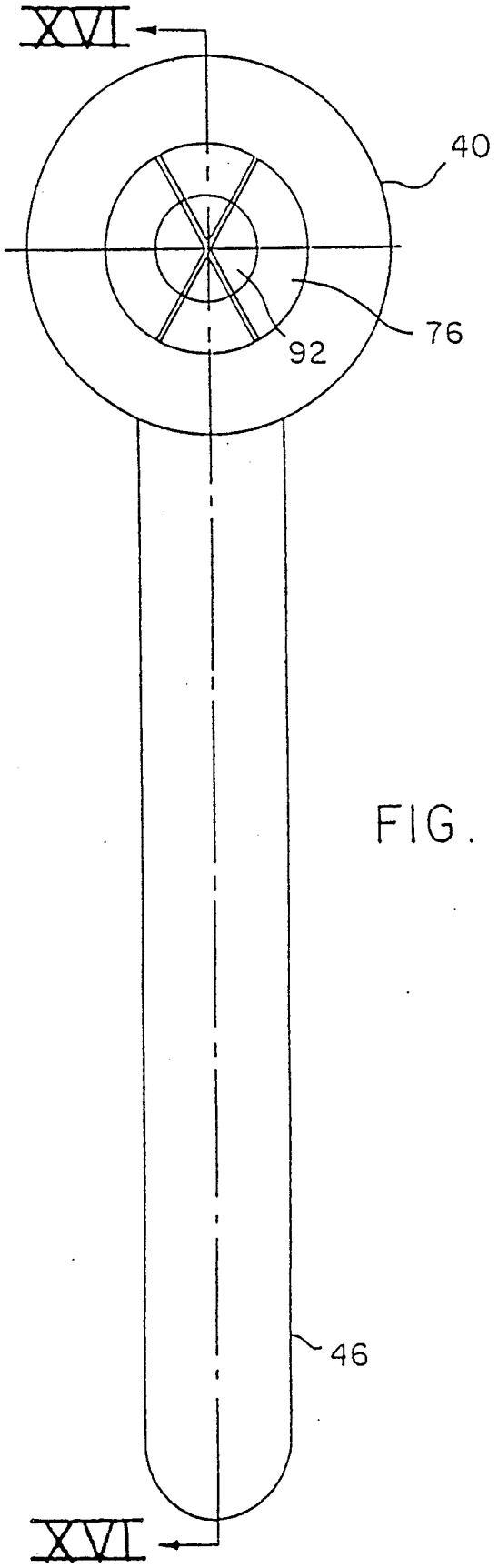
FIG. 15 is a front elevational view of the expanding tool of the present invention.
Figure 16:
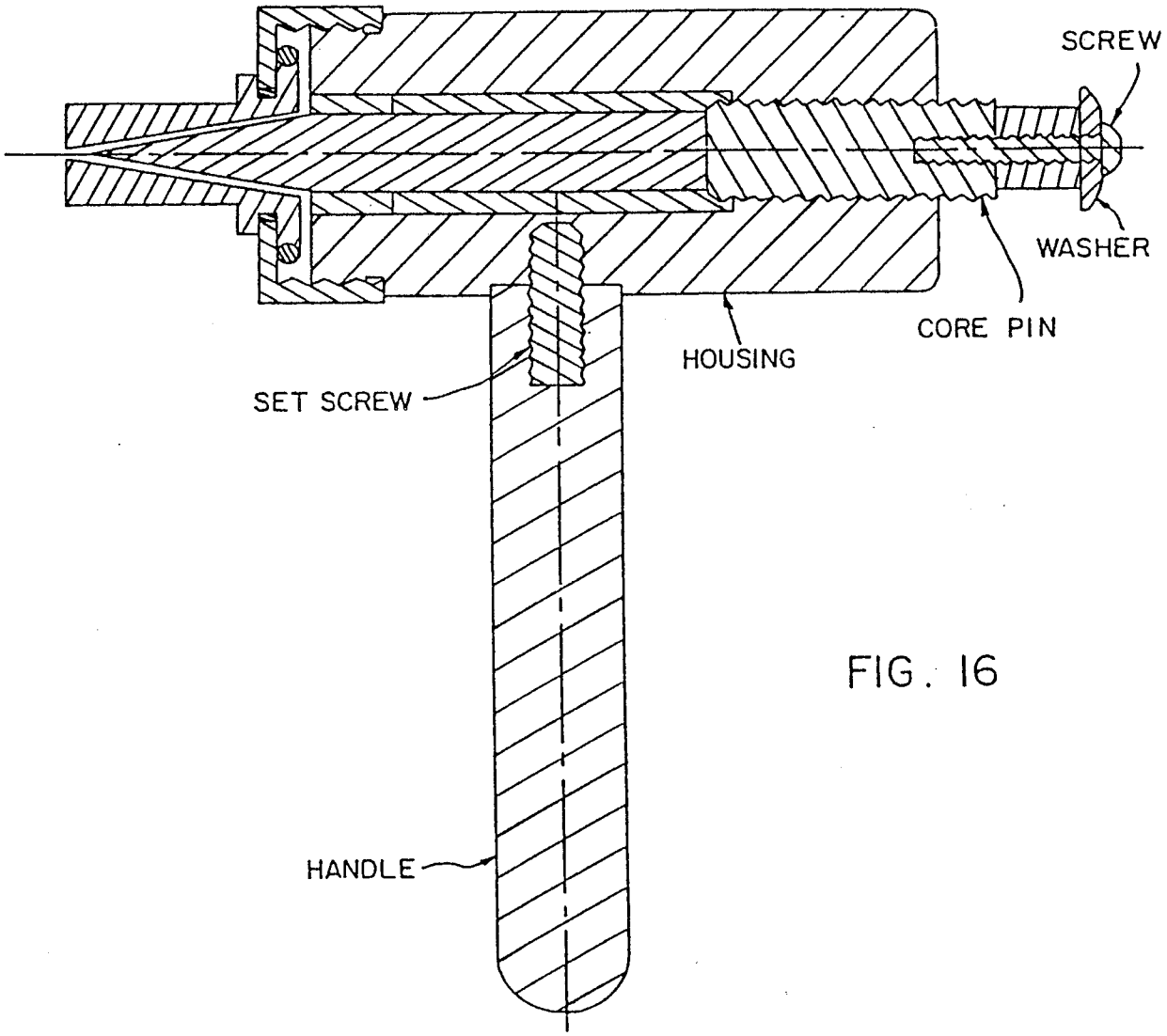
FIG. 16 is a side elevational view taken along line XVI—XVI of FIG. 15.
Figure 17:
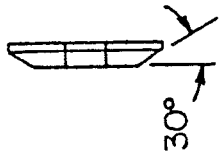
FIG. 17 is a side elevational view of a washer employed in the expanding tool of the present invention.
Figure 18:
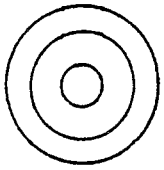
FIG. 18 is a front elevational view of the washer of FIG. 17.
Figure 19:
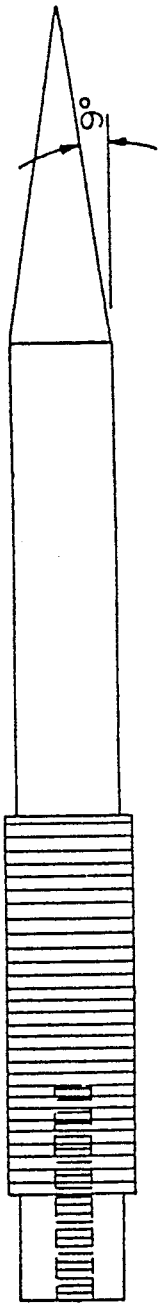
FIG. 19 is a side elevational view of the wedge apparatus of the present invention.
Figure 20:
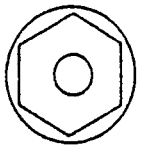
FIG. 20 is a front elevational view of the wedge apparatus of FIG. 19.
Figure 21:
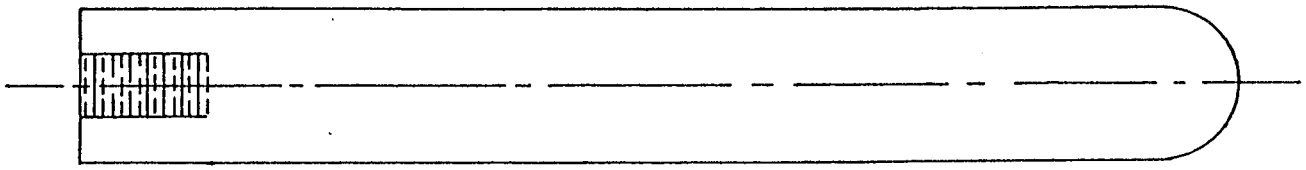
FIG. 21 is a side elevational view of a handle of the expanding tool of the present invention.
Figure 22:
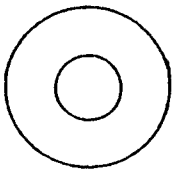
FIG. 22 is a front elevational view of the handle of FIG. 21.
Figure 24:
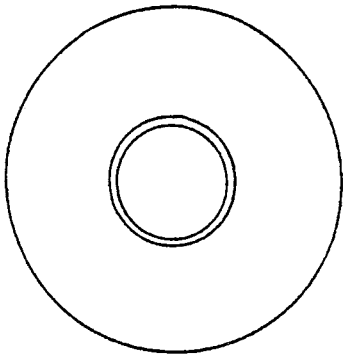
FIG. 24 is a front elevational view of the forming tool of FIG. 23.
Figure 23:
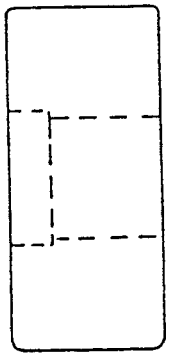
FIG. 23 is a side elevational view, in section, of the forming tool of the present invention.
Figure 26:
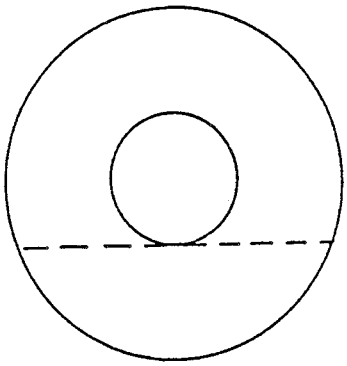
FIG. 26 is a front elevational view of the cutting tool of FIG. 25.
Figure 25:
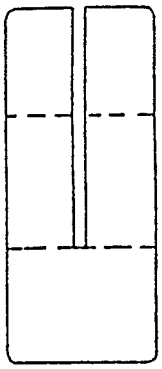
FIG. 25 is a side elevational view of the cutting tool employed in the present invention.
Figure 27:
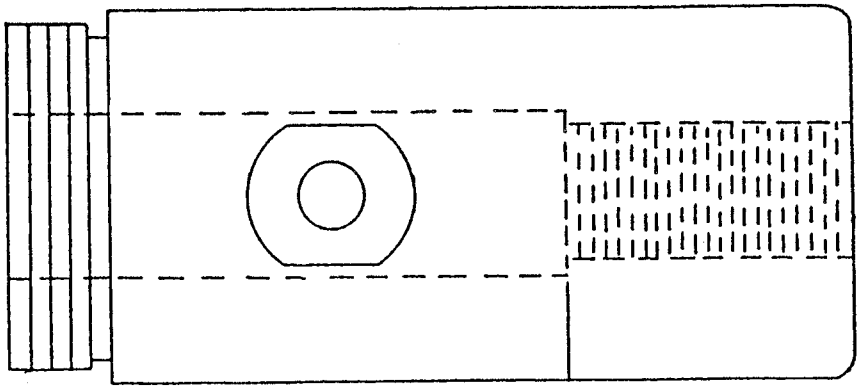
FIG. 27 is a bottom view, in section, of the cylinder of the expanding tool of the present invention.
Figure 28:
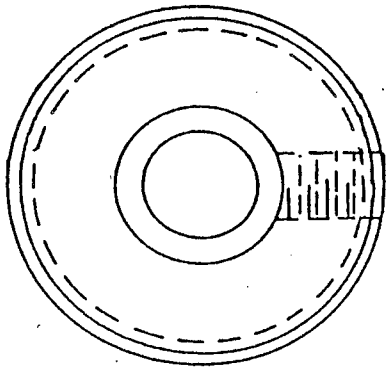
FIG. 28 is a front elevational view, in section, of the cylinder of FIG. 27.

Referring to FIG. 16, which is cross-section of FIG. 15, and to FIG. 19, 20 pound-feet of torque may be achieved through the proper relative sizing of parts of expanding tool 38. For example, wedge member 52 may have threads 54 that are at a pitch of about 10 to 30 threads per inch and, preferably, are about 18 threads per inch. Wedge surface 92 may form an angle 93 of about 5 to 15 degrees and may be about 9 degrees along a length of about 1¼ inches. Also, handles 46 and 62 may be approximately 3 to 9 inches and, preferably, are 5¼ inches to 6 inches long.

Other combinations may, also, be acceptable. However, if the pitch of threads 54 is too fine, then they may become damaged if too much torque is applied between handles 46 and 62. Likewise, if the pitch of thread 54 is too coarse, then angle 93, of wedge surface 92, must be increased, thereby making wedge surface 92 more "pointy." If angle 93 is not increased when coarse threads are employed, too much torque may have to be applied between handles 46 and 62 to effectively remove the corrugation from the pipe.

After the corrugations are removed by the method described above, handle 62 is then rotated in the opposite direction of arrow 60, relative to cylinder 40, thereby causing expansion segments 78 to retract to their initial position, as shown in FIG. 10, since, as wedge surface 92 is retracted from within expansion means 76, biasing means 72 pulls expansion segments 78 together.

As an alternative, two heads 70 may be employed in a two step process to form the end structure of conduit 10. The two step process is identical to that described above with the exception that a first head is, initially, used to provide an initial expansion of the diameter conduit end 28. Then, a second head, having expansion segments 78 which are larger than the expansion segments of the first head, is used to finally form end 28 of conduit 10.

This two step process may be advantageous, especially if the second head has expansion segments 78 that are too large to fit into conduit end 28 before any expansion, whatsoever, has taken place. If ratchet 69 is employed, then handle 62 is merely rocked back and forth, rather than fully rotated to flare out and retract.

As a further alternative, handle 62 may be replaced altogether with a commercially available electric wrench (not shown), such as those sold publicly by Sears, Roebuck and Company. The wrench would be mechanically connected to expanding tool 38 and would rotate wedge member 52 in the same manner as handle 62.

Figure 12:
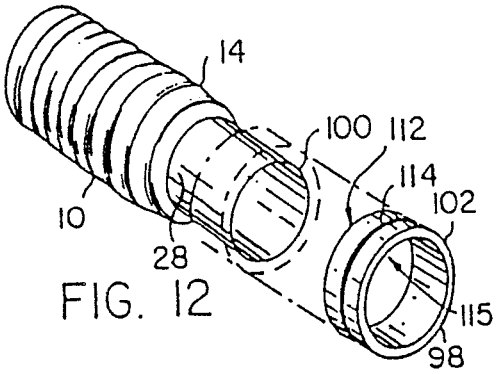
FIG. 12 is a perspective view of the conduit of FIG. 4 and a perspective view of a ring of the present invention.
Figure 13:
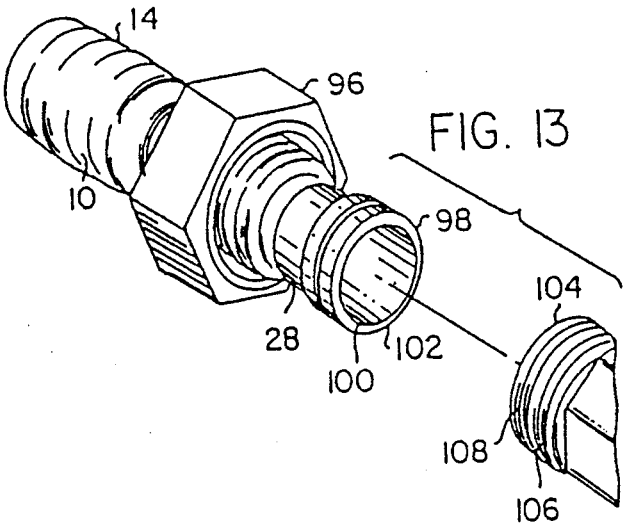
FIG. 13 is a perspective view of a nut and the ring of FIG. 12 which has been fitted on the conduit of FIG. 4 along with a perspective view of a portion of a fitting.

After use of expanding tool 38, conduit end 28 then has a relatively smooth surface, a squared-off end and is almost, if not completely, non-corrugated as shown in FIG. 12. Nut 96 is then positioned over jacket 14 of conduit 10 as shown in FIG. 13. Ring 98, which has an inner diameter slightly larger than the outer diameter of conduit end 28, is then slipped over flattened conduit end 28 as shown in FIGS. 12 and 13.

Ring 98 is a compression type ring which includes an annular ring portion 114. Ring portion 114 compasses or projects radially inwardly when forces in the direction of arrows 112 and 115 are applied to ring 98.

Figure 14:
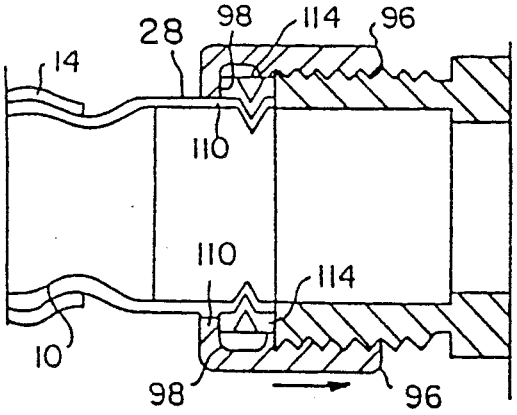
FIG. 14 is a side elevational view, in section, of the fitting of the present invention and the conduit of FIG. 4.

Referring to FIG. 13, it is preferable that ends 100 and 102 (shown in FIG. 12) generally meet together when ring 98 is positioned on flattened conduit end 28. End 104 of threaded connector 106 is then butted in contact with ends 100 and 102. Nut 96, which has threads (not shown) which correspond to and cooperate with threads 108 of threaded connector 106, is then screwed onto threaded connector 106 as shown in FIG. 14.

Shoulder 110 of nut 96 applies a force to ring 98 in the direction of arrow 112 which causes annular ring portion 114 to crimp and project radially inwardly, as described above. This radially inward projecting ring portion 114 mechanically engages the outer surface of conduit 10 as shown in FIG. 14. Further tightening of nut 96 on threaded connector 106 causes end 104 to be placed in tight surface-to-surface contact with at least end 102 and preferably both ends 100 and 102 and form a tight seal.

It may be appreciated, therefore, that the present invention provides an effective apparatus and associated method for connecting two conduits together in a sealed manner. The present invention may be employed to connect two corrugated pieces of conduit together as well as to connect a piece of corrugated conduit to a piece of noncorrugated conduit such as tubing or pipe. FIGS. 15 through 27 present various embodiments and dimensions which may be employed by the present invention.

FIGS. 29 and 30 show typical corrugated conduit 116. Conduit 116 includes a plurality of axially projecting raised portions 118 which define a diameter, $D_1$, which is larger than the diameter, $D_2$, of non-raised portions 120. Raised portions 118 define a radius $R_1$ while non-raised portions 120 define a radius $R_2$. Typical values for $D_1$, $D_2$, $R_1$ and $R_2$ are shown in the following table for various types of tubing.

Examples Of Typical Dimensions For Corrugated Tubing

| Type of Tubing | $D_1$ | $D_2$ | $R_1$ | $R_2$ |
|---|---|---|---|---|
| ¾" | 0.974" | 0.755" | 0.080" | 0.040" |
| ½" | 0.700" | 0.545" | 0.050" | 0.040" |
| ⅜" | 0.565" | 0.415" | 0.030" | 0.030" |

Of course, it is to be understood that the invention is not limited only to ¾", ½" and ⅜" tubing. Rather, the present invention is applicable to being employed with any size of tubing. Further, it is to be understood that the values depicted in the table above are only typical values for the given size of tubing since other values of the various dimensions may also be use. For example, ¾" tubing may employ a diameter $D_1$ which is not equal to 0.974". Likewise, other values for $D_1$, $D_2$, $R_1$ and $R_2$ are available for ¾", ½" and ⅜" tubing.

FIGS. 31 through 35 show two additional, alternative, embodiments of the claimed invention. Forming tool 122 comprises forming pieces 124 and 126 which are configured to meet together at parting line 128. Forming pieces 124 and 126 may be held together by bolts 130. As shown in FIG. 31, opening 132 includes a circumferential angled surface 134 which defines, preferably, an angle 136 which is, preferably, 45°.

Figure 33:
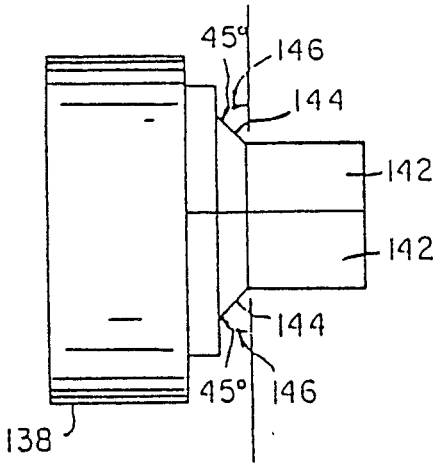
FIG. 33 is a side elevational view of a head of the present invention which has a partially flared circumferential surface.

As shown in FIG. 33, head 138, which may be constructed as previously described, has expansion segments 142, each of which having a circumferentially angled surface 144 which corresponds to angled surface 134 of forming tool 122. Angled surface 144, also preferably, forms an angle 146 that is, preferably, 45°. A conduit end is first prepared by cutting it with cutting tool 16, as shown in FIG. 3, and removing a portion of jacket 14 as shown in FIG. 4. Flared ring 164 is then slid onto, and well along, conduit 10. Conduit end 38 is then inserted into end 148 of forming tool 122 until the cut end of jacket 14 comes in contact with surface 150 of forming tool 122.

Figure 35:
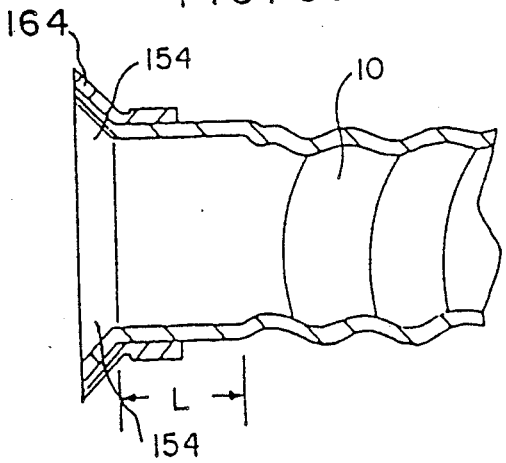
FIG. 35 is a conduit having an end formed by the devices depicted in FIGS. 31 through 33.

Conduit end 28 is prepared so that the squared-off cut end extends slightly past end 152. This occurs since the thickness of forming tool 122 is slightly thinner than L. Head 138, which is attached to expanding tool 38 as described above, is then inserted into end 152 of forming tool 122. Handle 62 is then rotated in a direction of arrow 60, or ratcheted, until the corrugation has been removed from the conduit and flange 154 has been formed on conduit 10 as shown in FIG. 35. The slightly projecting portion of conduit 10 will flare to a slightly larger diameter than that of opening 132 thereby reducing the possibility that conduit 10 will be rejected from forming tool 122 during the flange forming process. Flange 154 is created when angled surface 144 squeezes the end portion of conduit 10 against angled surface 134. Handle 62 is then rotated in the direction opposite arrow 60 and expanding tool 38 is then removed.

Because of flange 154, conduit 10 cannot be slid out of forming tool 122. Therefore, bolts 130 are removed from forming tool 122 and forming piece 124 is separated from forming piece 126, thereby allowing removal of conduit 10. Forming piece 124 may then be reconnected to forming piece 126, with bolts 130 or any other suitable fastener, and forming tool 122 is then ready for reuse. Ring 164 is then slid back to flange 154 and secured as described above.

Figure 32:
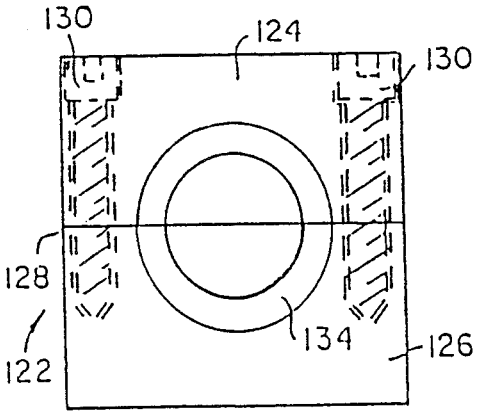
FIG. 32 is a front elevational view, partially in section of the forming tool of FIG. 31 taken along line XXXI—XXXI.

It is possible for forming tool 122, shown in FIGS. 31 and 32, to form a conduit end which does not include flange 154. In that case, conduit 10 would be inserted from the direction of end 152 toward end 148. Head 138 would then be inserted into the conduit from end 148 without inserting any of angle surface 144 into conduit 10. The corrugations would then be removed, in a manner similar to that described above, and head 138 would then be removed from inside conduit 10. Since no angled surface is present at end 148, of forming tool 122, and since angled surface 144, of head 138, would not be inserted into conduit 10, no flanged surface would be formed on the end of conduit 10.

Figure 34:
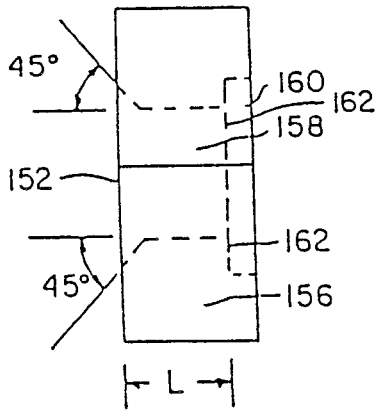
FIG. 34 is a side elevational view, partially in section, of another embodiment of the forming tool of the present invention.

Forming tool 156, shown in FIG. 34, is identical to forming tool 122, shown in FIGS. 31 and 32, with the exception that opening 158 has portion 160 which is of a larger diameter than the rest of opening 158. This embodiment of forming tool 156 is similar to that of the first embodiment described above in that conduit 10 could be further inserted into forming tool 156 until the cut end of jacket 14 comes in contact with shoulder 162.

While it may be appreciated that the invention has been described in the context of a conduit for gas, it may be appreciated that the present invention may also be employed in conjunction with other types of pipes and conduits such as electrical conduits. Also, the present invention may be employed as a connector for conduits which carry liquids under pressure, such as water.

The appended drawings in their entirety, including all dimensions depicted, are hereby incorporated into this Detailed Description of the Preferred Embodiments by reference.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Tool in kit form for deforming metal comprising:

removable mold means for being positioned in contact with corrugated conduit, said mold means comprising a generally cylindrical and generally annular ring means;

forming means for being positioned in contact with the end of the conduit, said forming means comprising expandable member means for applying a generally radially outward force on the interior of the end of the conduit when said expandable member means is expanded;

said mold means and said forming means being configured to cooperatively form an end structure of the conduit; and said mold means comprising a unitary structure providing a continuous inner periphery, having first wall means that define an opening.

2. The kit according to claim 1, wherein said opening is adapted to receive the end of the conduit.

3. The kit of claim 2, wherein said forming means is configured to be at least partially positioned within the interior of the end of the conduit.

4. The kit of claim 3, wherein said radially outward force applied by said expandable member means is for pressing the end of said expandable member means against said inner periphery of said mold means to form the conduit end structure when said expandable member means is expanded.

5. The kit of claim 4, wherein said expandable member means includes a plurality of expansion members.

6. The kit of claim 5, wherein:

said plurality of expansion members are movably supported in a movable configuration by biasing means; and said biasing means is spring means.

7. The kit of claim 6, wherein said mold means further includes second wall means adjacent said first wall means, said second wall means being configured to flare out from said first wall means for forming a flange on said conduit end structure.

8. The kit of claim 6, wherein:

said forming means defines a generally right circular cylinder;

said cylinder defines an opening;

said cylinder comprises aluminum;

said cylinder opening is adapted to receive wedge means;

said wedge means is configured to expand said expandable member means;

bushing means is positioned within said opening of said cylinder;

said bushing means is configured to at least partially surround said wedge means;

said bushing means comprises steel;

said opening of said cylinder defines a surface;

said surface defined by said opening of said cylinder defines first thread means;

said wedge means defines second thread means that cooperate with said first thread means; and said expandable member means comprises means for flaring out to apply said generally radially outward force on said interior of the end of the conduit.

said wedge means comprises heat treated glass;

said first thread means and said second thread means are left-handed threads;

said cylinder further includes collar means;

said expansion members are movably supported by said collar means;

said cylinder comprises aluminum alloy;

said bushing means comprises heat-treated steel;

said expansion members are machined from bar stock;

said first thread means and said second thread means are configured at a pitch of about eighteen threads per inch.

9. Tool in kit form for deforming metal comprising:

removable mold means for being positioned in contact with conduit, said mold means comprising a generally annular ring means;

forming means for being positioned in contact with the end of the conduit, said forming means comprising expandable member means for applying a generally radially outward force on the interior of the end of the conduit when said expandable member means is expanded;

said mold means and said forming means being configured to cooperatively form an end structure of the conduit; and said mold means comprising a unitary structure providing a continuous inner periphery.

10. The kit of claim 9, wherein said expandable member means includes a plurality of expansion members.

11. The method of claim 10, wherein said plurality of expansion members are movably supported in a movable configuration by biasing means.

12. The kit of claim 11, wherein:

said forming means defines a generally right circular cylinder;

said cylinder defines an opening;

said cylinder opening is adapted to receive wedge means;

said wedge means is configured to expand said expandable member means.

said opening of said cylinder defines a surface;

said surface defined by said opening of said cylinder defines first thread means;

said wedge means defines second thread means that cooperate with said first thread means;

said expandable member means comprises means for flaring out to apply said generally radially outward force on said interior of the end of the conduit; and means for receiving an elongated member for driving said wedge means to expand said expandable member means;

said first thread means and said second thread means comprising left-handed threads;

said first thread means and said second thread means being configured at a pitch of about eighteen threads per inch.

13. Apparatus for forming a coupling structure for the end of a conduit for gas transmission, said apparatus comprising:

removable mold means for being positioned in contact with the conduit, said mold means including a unitary structure having a continuous inner periphery;

an expanding tool having an expanding tool cylinder;

forming means being supported by said expanding tool cylinder for being positioned in contact with the end of the conduit, said forming means including a plurality of individual expansion segments movably positioned adjacent to one another in a circular arrangement for positioning within the end of the conduit, said expansion segments being movable radially between a retracted position and an expanded position;

biasing means for normally urging said expansion segments to said retracted position; and drive means movable within said circular arrangement of said expansion segments to move said expansion segments radially outwardly against the force of said biasing means from said retracted position to said expanded position to squeeze the conduit between said expansion segments and said unitary structure continuous inner periphery.

14. The apparatus according to claim 13, wherein said mold means has first wall means that define an opening of a predetermined dimension.

15. The apparatus of claim 14, wherein said opening defined by said mold means is generally circular.

16. The apparatus of claim 15, wherein said opening is adapted to receive of the end of the conduit; and each of said expansion segments is configured to be at least partially positioned within the interior of the end of the conduit.

17. The apparatus of claim 16, wherein:

said expansion segments form an outer circular surface having a diameter permitting insertion of said expansion segments in said retracted position within said interior of the end of the conduit; and said radially outward force applied by said expansion segments presses the end of the conduit against said unitary structure continuous inner periphery to form the conduit end structure.

18. The apparatus of claim 17, wherein said expansion segments in said retracted position have an outer diameter slightly smaller than the inner diameter of the conduit.

19. The apparatus of claim 18, wherein said plurality of expansion segments are independently positioned relative to one another and supported in the conduit in said retracted position by said biasing means.

20. The apparatus of claim 19, wherein said biasing means is spring means.

21. The apparatus of claim 20, wherein said mold means further includes second wall means adjacent said first wall means, said second wall means being configured to flare out from said first wall means for forming a flange on said conduit end structure.

* * * * *

UNITED STATES PATENT AND TRADEMARK OFFICE

CERTIFICATE OF CORRECTION

PATENT NO. : 5,138,863

DATED : August 18, 1992

INVENTOR(S) : Anthony S. Kistner, Wayne M. Staats, Norman O. Staats

It is certified that error appears in the above-identified patent and that said Letters Patent is hereby corrected as shown below:

In column 11, in Claim 8, line 53, after 'treated', delete "glass" and insert --steel--.

Signed and Sealed this

Eleventh Day of January, 1994

*Attest:*

*Attesting Officer*

BRUCE LEHMAN

*Commissioner of Patents and Trademarks*